US012031296B2

(12) United States Patent
Fujishima et al.

(10) Patent No.: US 12,031,296 B2
(45) Date of Patent: Jul. 9, 2024

(54) CONSTRUCTION MACHINE

(71) Applicant: Hitachi Construction Machinery Co., Ltd., Tokyo (JP)

(72) Inventors: Hiroaki Fujishima, Tsuchiura (JP); Hiroshi Kumagai, Ryugasaki (JP); Yasuhiko Inaba, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 681 days.

(21) Appl. No.: 17/273,491

(22) PCT Filed: Feb. 4, 2020

(86) PCT No.: PCT/JP2020/004020
§ 371 (c)(1),
(2) Date: Mar. 4, 2021

(87) PCT Pub. No.: WO2020/175028
PCT Pub. Date: Sep. 3, 2020

(65) Prior Publication Data

US 2021/0381196 A1 Dec. 9, 2021

(30) Foreign Application Priority Data

Feb. 28, 2019 (JP) ..... 2019-035798

(51) Int. Cl.
*E02F 9/08* (2006.01)

(52) U.S. Cl.
CPC ..... *E02F 9/0883* (2013.01); *E02F 9/0833* (2013.01)

(58) Field of Classification Search
CPC ..... E02F 9/0883; E02F 9/0833
See application file for complete search history.

(56) References Cited

U.S. PATENT DOCUMENTS 7,722,308 B2 5/2010 Sakitani et al.
8,413,676 B2 * 4/2013 Umizaki ..... B60K 15/01 137/355.16

(Continued)

FOREIGN PATENT DOCUMENTS

CN 102781705 A 11/2012
JP 2001-59237 A 3/2001

(Continued)

OTHER PUBLICATIONS

Japanese-language Office Action issued in Japanese Application No. 2019-035798 dated Apr. 5, 2022 with English translation (five (5) pages).

(Continued)

*Primary Examiner* — Tony H Winner
*Assistant Examiner* — Michael R Stabley
(74) *Attorney, Agent, or Firm* — Crowell & Moring LLP

(57) ABSTRACT

A fuel tank (16) for storing fuels is located between a right side frame (8) and a center frame (6) of a revolving frame (5) and is disposed on the center frame (6) side. Also, a hydraulic oil tank (19) for storing hydraulic oil is disposed adjacent to the fuel tank (16) in the right-and-left direction on the side of the right side frame (8) closer to an outer side in the right-and-left direction than the fuel tank (16). In addition, a top surface portion (19E) of the hydraulic oil tank (19) is disposed at a position higher than that of a top surface portion (16E) of the fuel tank (16).

2 Claims, 8 Drawing Sheets

(56) References Cited

U.S. PATENT DOCUMENTS

| | | | | |
|---|---|---|---|---|
| 8,876,163 | B2 * | 11/2014 | Nishiyama | B60K 15/063 280/830 |
| 9,010,809 | B2 * | 4/2015 | Nishiyama | E02F 9/0866 280/830 |
| 9,212,466 | B2 * | 12/2015 | Yokota | E02F 9/0808 |
| 9,366,009 | B2 * | 6/2016 | Shintani | E02F 9/0833 |
| 9,428,882 | B2 * | 8/2016 | Murakami | E02F 9/0833 |
| 9,663,919 | B2 * | 5/2017 | Hwang | E02F 9/18 |
| 2012/0067660 | A1 * | 3/2012 | Kashu | E02F 9/0883 280/830 |
| 2012/0174566 | A1 * | 7/2012 | Yamashita | E02F 9/0833 60/295 |
| 2013/0037551 | A1 | 2/2013 | Nishiyama et al. | |
| 2016/0138242 | A1 | 5/2016 | Hwang | |

FOREIGN PATENT DOCUMENTS

| | | | |
|---|---|---|---|
| JP | 2002-61224 | A | 2/2002 |
| JP | 2005-41316 | A | 2/2005 |
| JP | 2011-42994 | A | 3/2011 |
| JP | 2013-64255 | A | 4/2013 |
| JP | 2016-176290 | A | 10/2016 |
| WO | WO 2015/005506 | A1 | 1/2005 |

OTHER PUBLICATIONS

Extended European Search Report issued in European Application No. 20763965.9 dated May 13, 2022 (six (6) pages).

Chinese-language Office Action issued in Chinese Application No. 202080004922.3 dated Jan. 13, 2022 (eight (8) pages).

International Search Report (PCT/ISA/210) issued in PCT Application No. PCT/JP2020/004020 dated Mar. 10, 2020 with English translation (five (5) pages).

Japanese-language Written Opinion (PCT/ISA/237) issued in PCT Application No. PCT/JP2020/004020 dated Mar. 10, 2021 (three (3) pages).

* cited by examiner

CONSTRUCTION MACHINE

TECHNICAL FIELD

The present disclosure relates to a construction machine such as a hydraulic excavator with a fuel tank and a hydraulic oil tank provided on a vehicle body frame, for example.

BACKGROUND ART

A hydraulic excavator is generally configured, as a construction machine, by a lower traveling structure that is self-propelled in a front-and-rear direction, an upper revolving structure mounted rotatably on the lower traveling structure, and a working mechanism provided capable of moving upward/downward on the upper revolving structure.

The upper revolving structure includes a revolving frame as a vehicle body frame composed of a support structural body. The revolving frame is configured to include a center frame disposed in the center in the right-and-left direction perpendicular to a front-and-rear direction, a left side frame provided on the left side of the center frame and extending in the front-and-rear direction, and a right side frame provided on the right side of the center frame and extending in the front-and-rear direction. A fuel tank storing fuels and a hydraulic oil tank storing hydraulic oil are provided on the revolving frame.

Generally, a fuel tank that is regularly refueled is disposed on an outer side in the right-and-left direction having easy access from the outside, for example, on the right side. Meanwhile, a hydraulic oil tank is disposed adjacent to the left side of the fuel tank (Patent Document 1).

PRIOR ART DOCUMENT

Patent Document

Patent Document 1: Japanese Patent Laid-Open No. 2011-042994 A

SUMMARY OF THE INVENTION

In recent hydraulic excavators, an upper revolving structure is formed in a compact size such that they can revolve even in a narrow working site. The resulting smaller revolving frame unfortunately provides a limited space thereon for installing equipment such as an engine. In such a hydraulic excavator, an installation space is inevitably extended upward to install equipment such as an engine, leading to larger height dimensions for equipment and higher installation positions.

One typical problem caused by larger height dimensions for equipment and higher installation positions will be described. First, air bleeding work is performed in a hydraulic circuit when a hydraulic excavator is assembled or hydraulic oil is replaced. In the air bleeding work in a hydraulic circuit, an overall distribution of hydraulic oil throughout each portion (air bleeding) is confirmed by discharging hydraulic oil from an oil hole (air bleeding hole) located at an uppermost portion of the hydraulic pump when filling the hydraulic oil tank with hydraulic oil. At this time, an operator fills the hydraulic oil tank with hydraulic oil while visually confirming that the height of the hydraulic oil surface level approximates the reference oil surface corresponding to a height when the hydraulic oil is distributed throughout each portion, using an oil level gauge provided at the hydraulic oil tank to avoid overflow of the hydraulic oil from the oil hole of the uppermost portion of the hydraulic pump.

However, as described above, the installation of a hydraulic pump as part of equipment at a higher position provides a higher reference oil surface (position of oil hole located at the uppermost portion), which requires a mounting position of the oil level gauge of the hydraulic oil tank to be higher. Accordingly, the height dimension of the hydraulic oil tank must be larger. As a result, there is an operational concern that a working mechanism in operation could interfere with a hydraulic oil tank, with a hydraulic hose at a higher position provided on the working mechanism supplying and discharging hydraulic oil to a hydraulic actuator.

In addition, a top surface portion of the hydraulic oil tank is employed as a foothold maintaining equipment including an engine. Therefore, a handrail for an operator to hold is provided on the periphery of the hydraulic oil tank when getting on/off or operating the machine. Thus, a larger height dimension of the hydraulic oil tank leads to a larger height dimension from the ground to the foothold, thereby necessitating replacement of a handrail with a safer guide rail (ISO2867 (2011)). Nevertheless, such a replaced guide rail, having a larger height dimension than the handrail, can exceed the height limit during transport. In this case, the guide rail must be removed each time the hydraulic excavator is transported, which makes the transport laborious.

One embodiment of the present invention has an object to provide a construction machine capable of solving problems caused by larger height dimensions of a hydraulic oil tank.

One embodiment of the present invention is to provide a construction machine including: a vehicle body frame composed of a support structural body of a vehicle body that is self-propelled in a front-and-rear direction and including a center frame disposed in the center in the right-and-left direction perpendicular to the front-and-rear direction, a left side frame provided on the left side of the center frame and extending in a front-and-rear direction, and a right side frame provided on the right side of the center frame and extending in the front-and-rear direction; a fuel tank storing fuels provided on the vehicle body frame; and a hydraulic oil tank storing hydraulic oil provided on the vehicle body frame, in which the fuel tank is located between either the left side frame or the right side frame of the vehicle body frame and the center frame and disposed on the center frame side, the hydraulic oil tank is disposed adjacent to the fuel tank in the right-and-left direction on the side of the one side frame closer to an outer side in the right-and-left direction than the fuel tank, and a top surface portion of the hydraulic oil tank is disposed at a position higher than that of a top surface portion of the fuel tank.

One embodiment of the present invention can solve problems caused by larger height dimensions of a hydraulic oil tank.

BRIEF DESCRIPTION OF THE DRAWINGS

FIG. 5 is a plan view of an upper revolving structure without an exterior cover, a handrail, or the like.

FIG. 6 is a perspective view of the upper revolving structure viewed from the right rear side without a counterweight, an exterior cover, a handrail, or the like.

FIG. 8 is a partially sectioned enlarged front view of the revolving frame, an engine, a hydraulic pump, the hydraulic oil tank and the like.

MODE FOR CARRYING OUT THE INVENTION

An ultra short rear tail swing radius type hydraulic excavator, as an exemplary construction machine according to an embodiment of the present invention, will be described in detail with reference to FIGS. 1 to 8.

Figure 1:
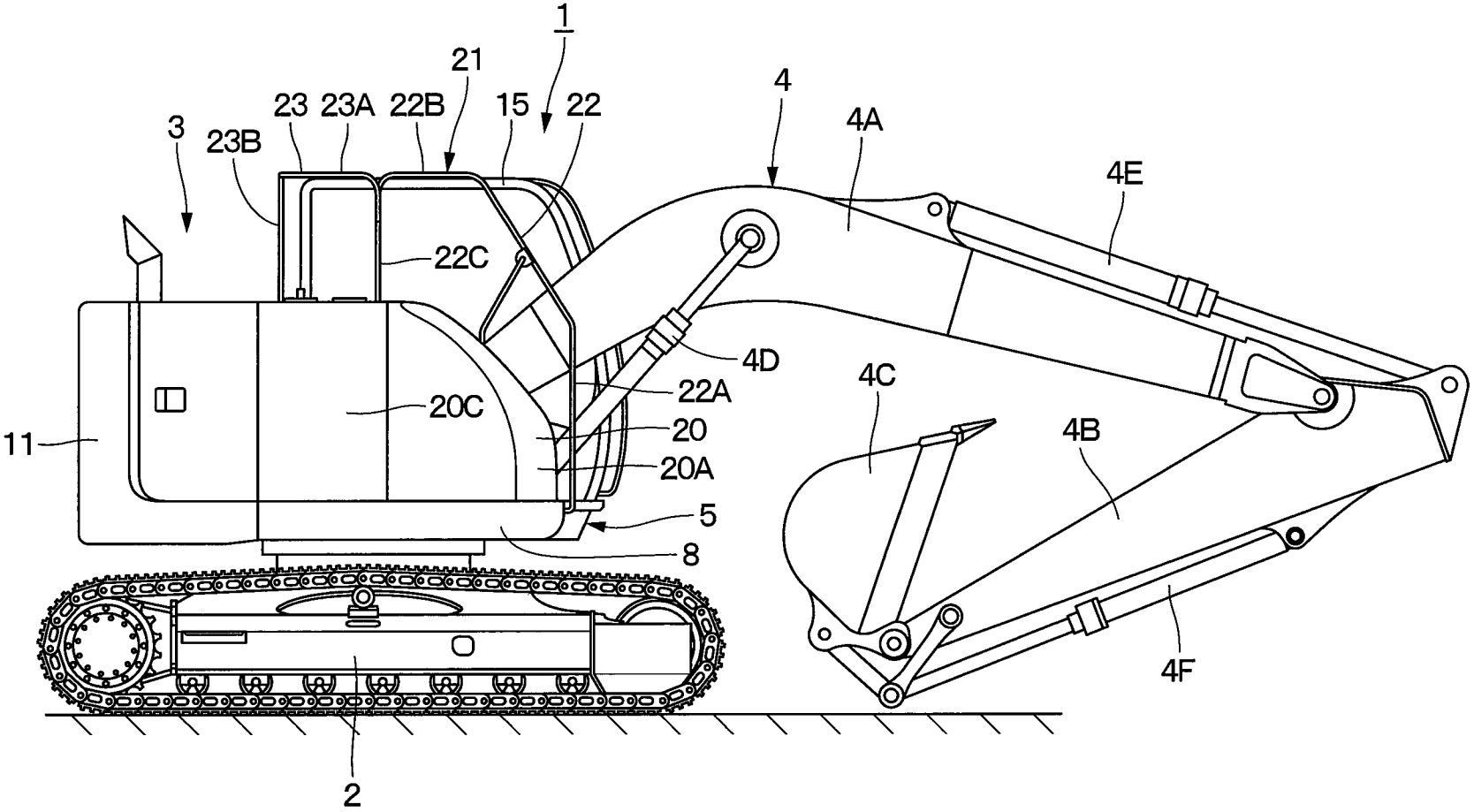
FIG. 1 is a front view of a hydraulic excavator according to one embodiment of the present invention.

In FIG. 1, a hydraulic excavator 1 constitutes a crawler type construction machine. The hydraulic excavator 1 includes a crawler-type lower traveling structure 2 that is self-propelled in a front-and-rear direction, an upper revolving structure 3 mounted rotatably on the lower traveling structure 2 to constitute a vehicle body together with the lower traveling structure 2, and a working mechanism 4 provided capable of moving upward/downward on a front side in a front-and-rear direction of the upper revolving structure 3.

Figure 3:
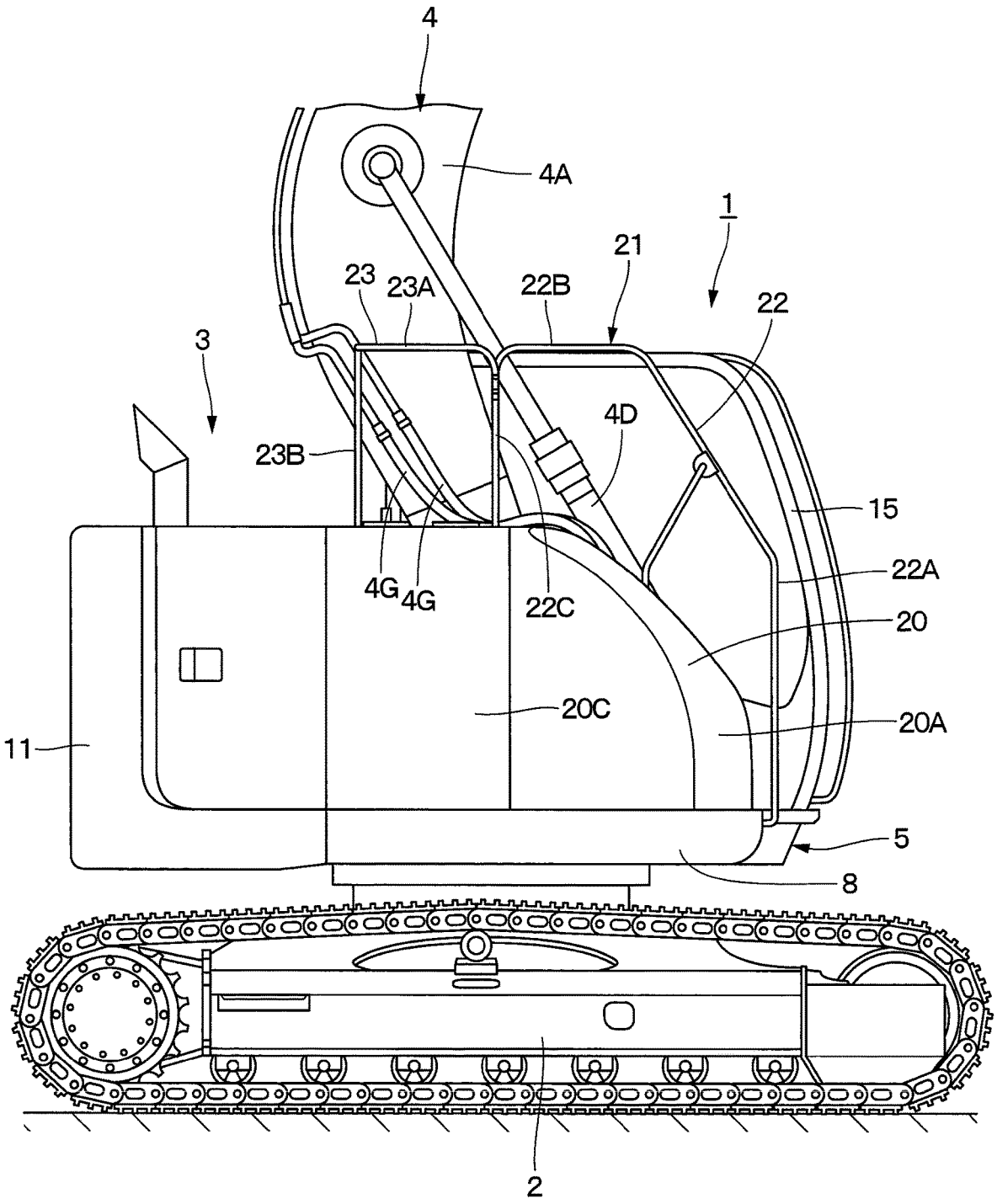
FIG. 3 is an enlarged front view of the hydraulic excavator with a boom of a working mechanism moving upward-downward.
Figure 4:
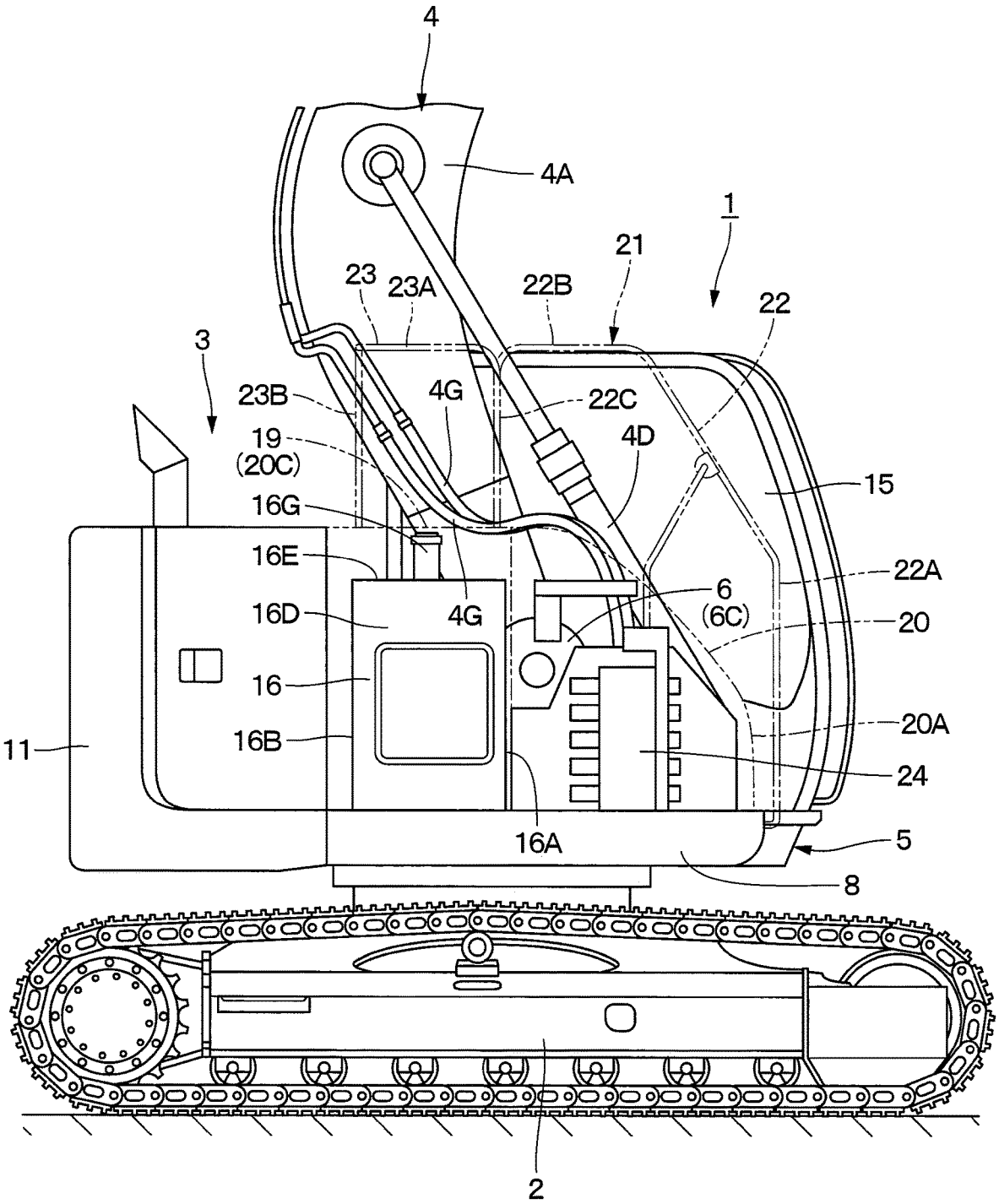
FIG. 4 is a front view of the hydraulic excavator shown in FIG. 3 without a hydraulic oil tank, an exterior cover, or a handrail.

The working mechanism 4 performs excavating work of earth and sand, and is configured to include a boom 4A, an arm 4B, a bucket 4C, a boom cylinder 4D, an arm cylinder 4E, and a bucket cylinder 4F. Also, as shown in FIGS. 3 and 4, the working mechanism 4 is provided with a plurality of hydraulic hoses 4G supplying and discharging pressurized oil to the arm cylinder 4E and the bucket cylinder 4F (only two hoses shown in the figures) so as to be contoured for a right side surface of the boom 4A. Each of the hydraulic hoses 4G is formed as, for example, a pipe body including a flexible hose and a metallic pipe in combination.

Figure 5:
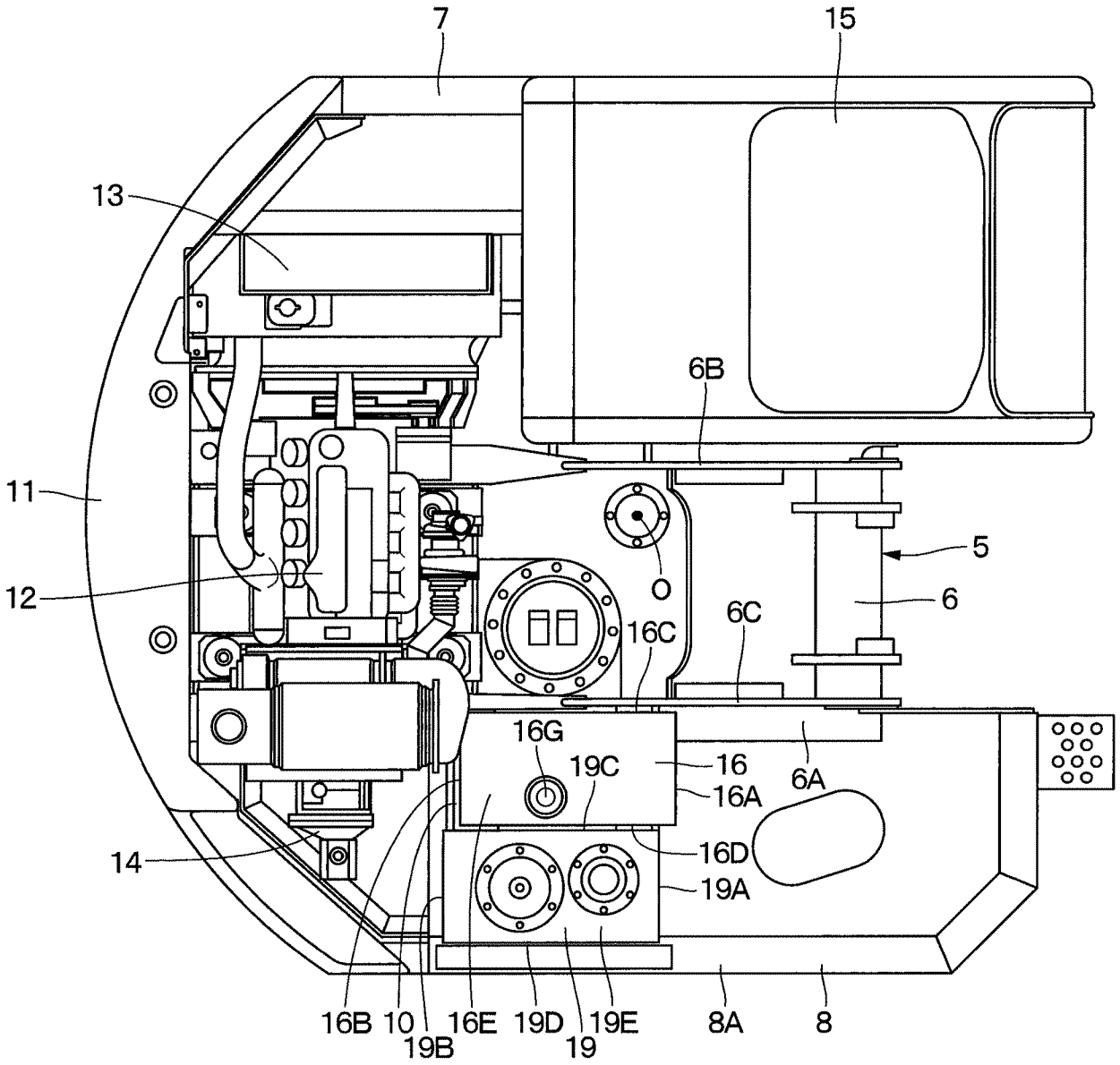

The upper revolving structure 3 has a width dimension in the right-and-left direction, which is almost the same as the vehicle width of the lower traveling structure 2. In addition, as shown in FIG. 5, the upper revolving structure 3 is disposed on the front side (at a position close to a below-described cab 15) such that a below-described counterweight 11 approximates a revolving center O. As a result, the hydraulic excavator 1 is configured as an ultra short rear tail swing radius type hydraulic excavator that allows an outer peripheral surface of a counterweight 11 to be accommodated almost within a vehicle width of the lower traveling structure 2 when the upper revolving structure 3 revolves on the lower traveling structure 2.

Figure 6:
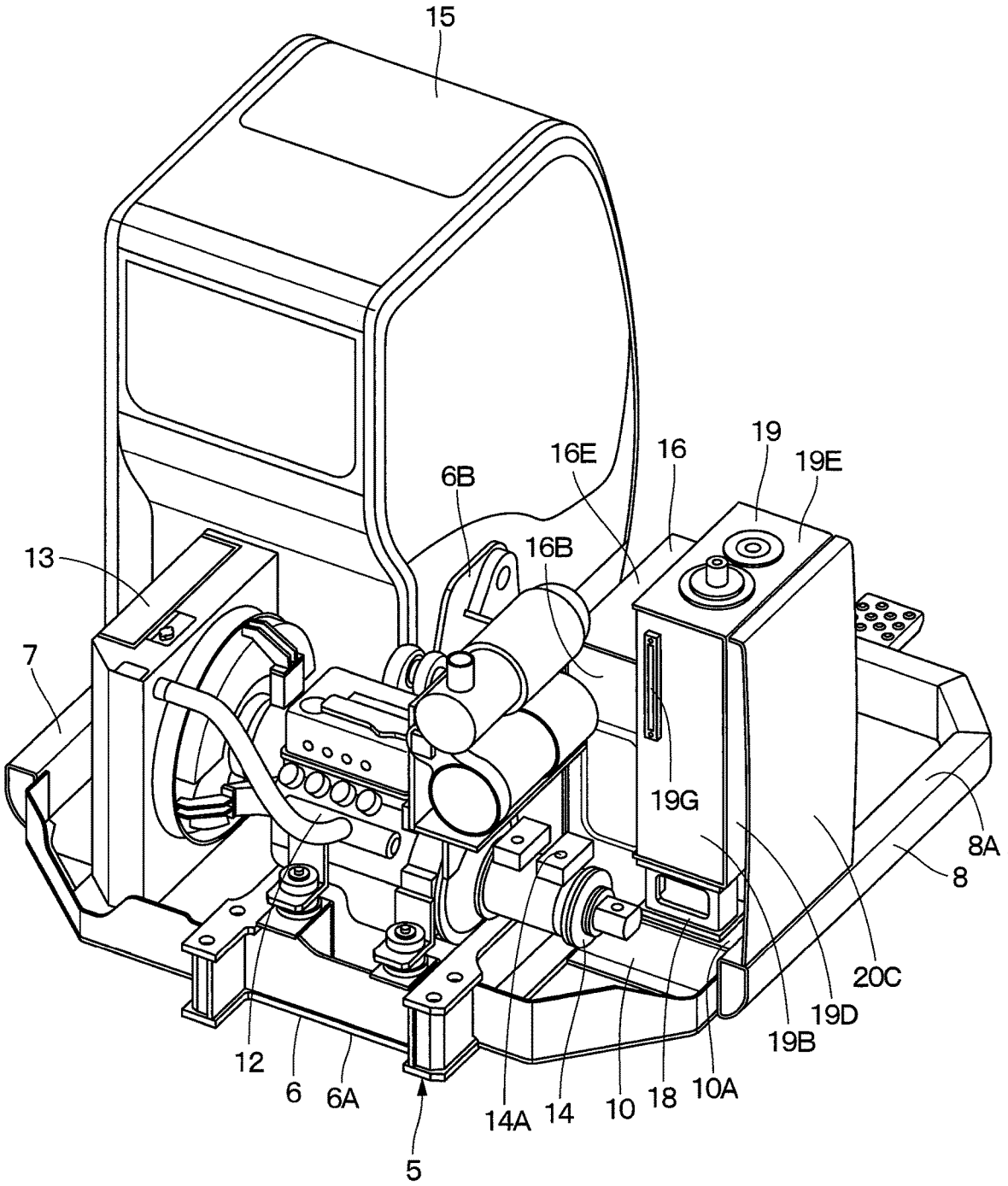

A revolving frame 5 forms a vehicle body frame that is to be a base of the upper revolving structure 3. As shown in FIGS. 5 and 6, the revolving frame 5 includes a center frame 6 disposed in the center in the right-and-left direction of the upper revolving structure 3, a left side frame 7 provided by extending in a front-and-rear direction of the upper revolving structure 3 on the left side of the center frame 6, and a right side frame 8 provided by extending in the front-and-rear direction of the upper revolving structure 3 on the right side of the center frame 6.

The center frame 6 is configured by a bottom plate 6A composed of a thick steel plate extending in a front-and-rear direction or the like, and a left vertical plate 6B and a right vertical plate 6C to be installed upright on the bottom plate 6A and extending in the front-and-rear direction at a predetermined interval in the right-and-left direction. The boom 4A of the working mechanism 4 is mounted capable of moving upward/downward on a front side of the left vertical plate 6B and the right vertical plate 6C, and a counterweight 11 is mounted on a rear side thereof. The left side frame 7 is supported on the left side of the center frame 6 through a plurality of left extension beams (not shown) extending in the right-and-left direction at an interval in a front-and-rear direction from the center frame 6.

Furthermore, the right side frame 8 forms one side frame. The right side frame 8 is bent leftward at the front portion toward the center frame 6. The right side frame 8 is composed of a structure (D frame) whose internal cavity has a D-shaped cross section, and an upper portion thereof corresponds to a flat upper surface 8A. The right side frame 8 is supported on the right side of the center frame 6 through a below-described right front extension beam 9 and a right rear extension beam 10 and the like.

Figure 7:
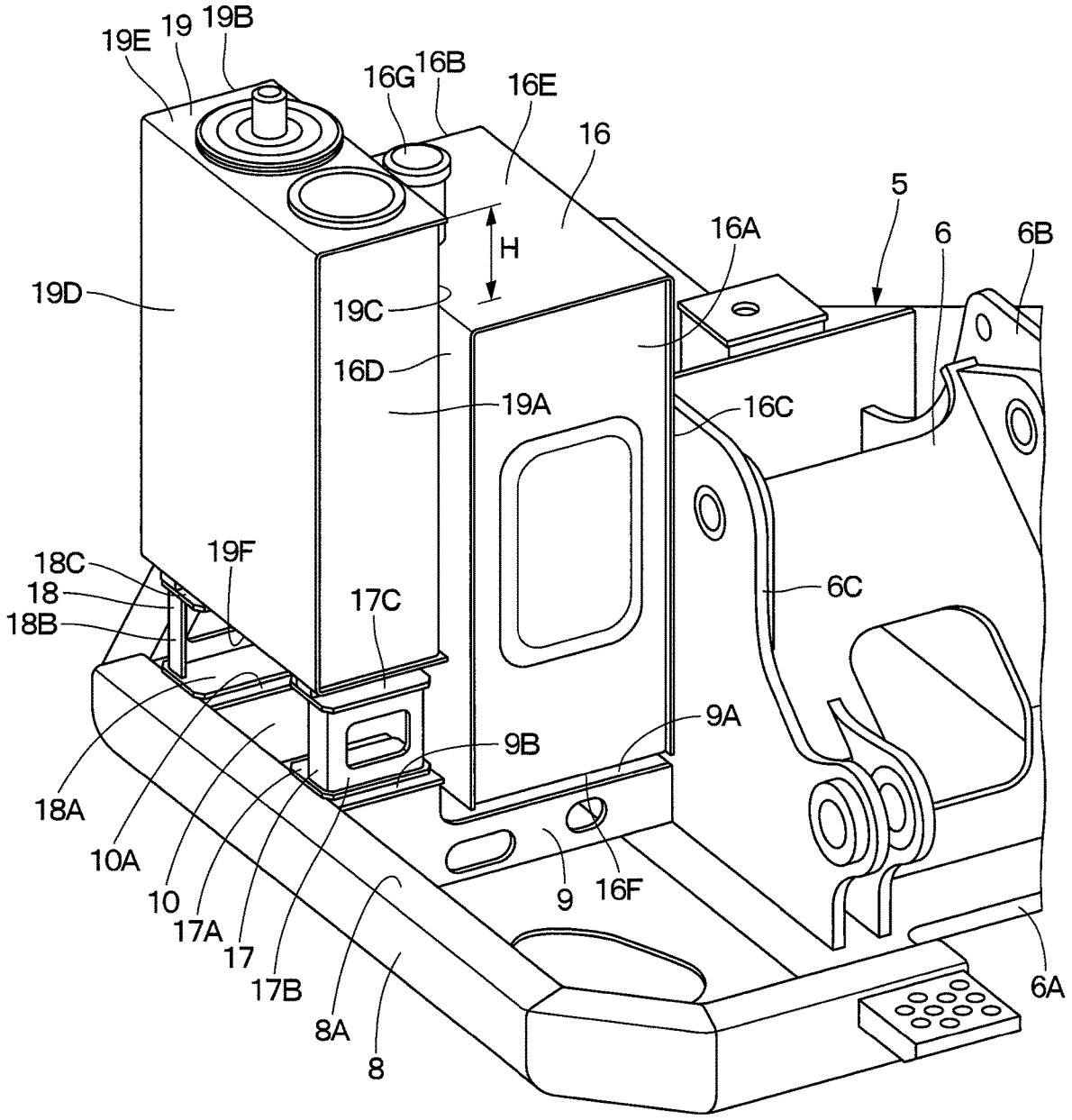
FIG. 7 is an enlarged perspective view of main parts of a revolving frame, a fuel tank, a hydraulic oil tank and the like viewed from the right front side.

As shown in FIGS. 6 and 7, the right front extension beam 9 and the right rear extension beam 10 support the right side frame 8 at an interval on the right side of the center frame 6. The right front extension beam 9 and the right rear extension beam 10 are disposed at an interval in a front-and-rear direction at an intermediate position in the front-and-rear direction, each extending in the right-and-left direction. The right front extension beam 9 and the right rear extension beam 10 are mounted on the left side the center frame 6, and mounted on the right side on the right side frame 8.

In the right front extension beam 9, an upper portion on the left side from an intermediate portion in the right-and-left direction is a fuel tank attachment site 9A, and an upper portion on the right side from the intermediate portion is a hydraulic oil tank attachment site 9B as a tank attachment site. The fuel tank attachment site 9A supports a fuel tank 16, and is formed so as to have a smaller height dimension than the hydraulic oil tank attachment site 9B.

The hydraulic oil tank attachment site 9B has a height position, which is higher than that of the fuel tank attachment site 9A and equivalent to that of the upper surface 8A of the right side frame 8. The hydraulic oil tank attachment site 9B supports a front side portion of a hydraulic oil tank 19 through a below-described tank support base 17. A lower mounting plate 17A of a tank support base 17 is mounted on the hydraulic oil tank attachment site 9B, using bolts (not shown).

In the right rear extension beam 10, an upper portion on the left side is a fuel tank attachment site (not shown), and an upper portion on the right side is a hydraulic oil tank attachment site 10A as a tank attachment site, as shown in the right front extension beam 9. Also, a lower mounting plate 18A of a tank support base 18 is mounted on the hydraulic oil tank attachment site 10A, using bolts.

As shown in FIG. 5, the counterweight 11 is provided at a rear portion of the center frame 6 of the revolving frame 5. The counterweight 11 is formed as an arc-shaped heavy article, i.e., a center part in the right-and-left direction projecting rearward to take a weight balance with the working mechanism 4. The counterweight 11 is disposed closer to a front side of the revolving center O of the revolving frame 5 so as to have a shorter revolving radius of the upper revolving structure 3.

An engine 12 is located on a front side of the counterweight 11, and transversely mounted by extending in the right-and-left direction on a rear side of the revolving frame 5. A heat exchanger 13, including a radiator, an oil cooler, and the intercooler, is disposed on the left side of the engine 12. A later-described hydraulic pump 14 is mounted on the right side of the engine 12.

Figure 8:
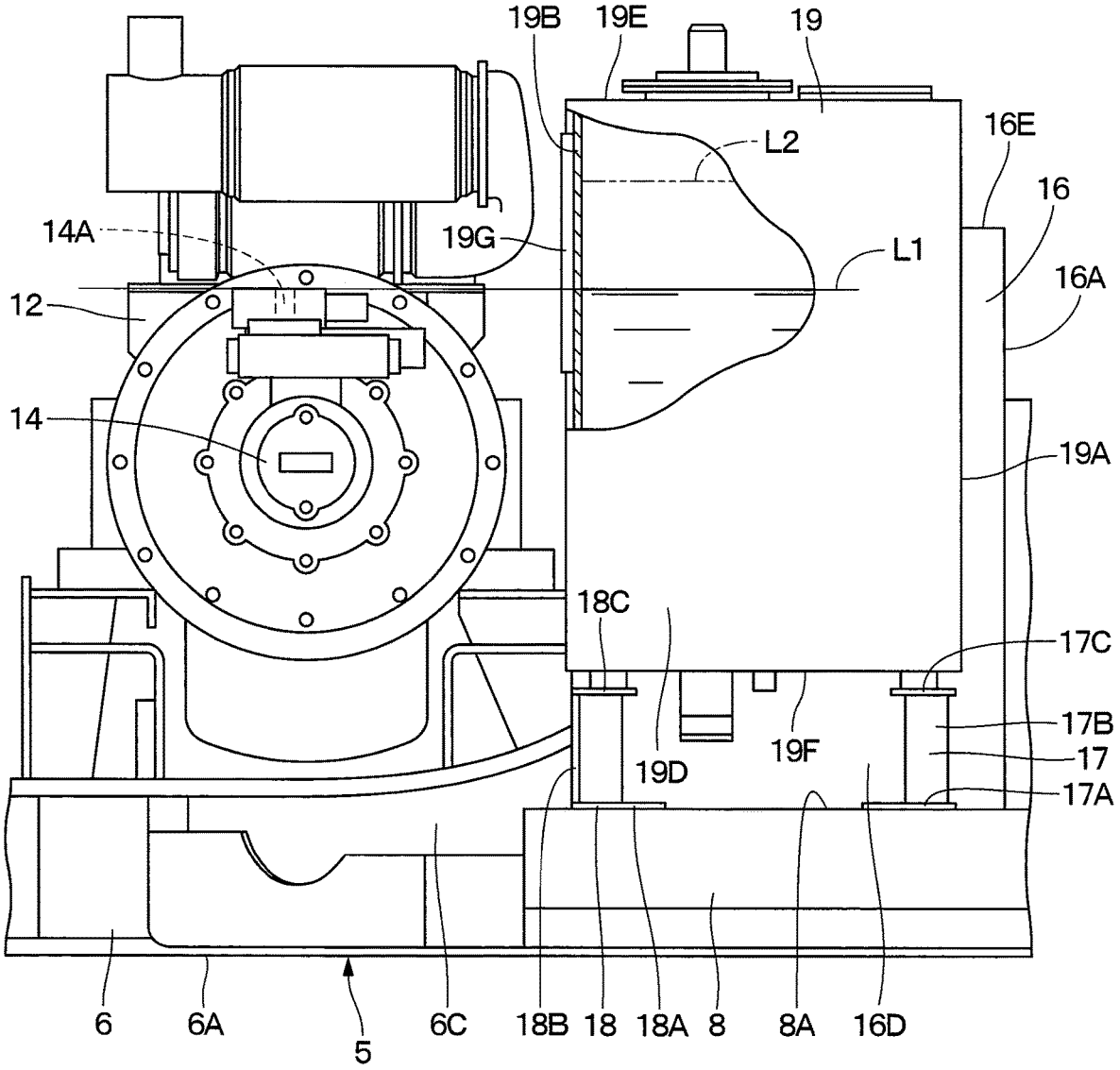

A hydraulic pump 14 is mounted on the right side of the engine 12. The hydraulic pump 14 discharges hydraulic oil supplied from the hydraulic oil tank 19 as pressurized oil toward a later-described control valve 24. In the hydraulic pump 14, air bleeding work is performed by bleeding internal air and filling the pump with hydraulic oil to prevent the compression performance from declining due to residual internal air when a hydraulic excavator 1 is assembled or hydraulic oil is replaced, for example. Then, as shown in FIGS. 6 and 8, the hydraulic pump 14 is provided with an air bleeding hole 14A at the highest position in a hydraulic oil passage. The height position at which the air bleeding hole 14A opens corresponds to a reference oil surface L1 of the hydraulic oil in the hydraulic oil tank 19 (see FIG. 8).

In addition, the hydraulic pump 14 of this embodiment is mounted on the ultra short rear tail swing radius type hydraulic excavator 1, and formed in a large size (and at a higher position) in the vertical direction to achieve a large delivery flow amount relative to a small installation area. As a result, the reference oil surface L1 of the hydraulic oil of the hydraulic oil tank 19 is set at a high position.

A cab 15 is mounted on a left front side of the revolving frame 5 for an operator to get on. An operator's seat for an operator to be seated, a traveling control lever, a working control lever, and switches (each not shown) are disposed inside the cab 15.

The fuel tank 16 is located between the center frame 6 and the right side frame 8 of the revolving frame 5 and is disposed on the center frame 6 side. Specifically, the fuel tank 16 is in proximity to the right side of the right vertical plate 6C of the center frame 6 to be faced therewith, and disposed adjacent to the left side of a later-described hydraulic oil tank 19. The fuel tank 16 is mounted on an upper portion of the fuel tank attachment site 9A of the right front extension beam 9 and the fuel tank attachment site of the right rear extension beam 10. The fuel tank 16 is formed as a rectangular shaped container extending in the vertical direction, including a front surface portion 16A, a rear surface portion 16B, a left surface portion 16C, a right surface portion 16D, a top surface portion 16E, and a bottom surface portion 16F. The fuel tank 16 stores fuels to be supplied to the engine 12. The top surface portion 16E is provided with a fuel filling opening 16G filling fuels projecting upward.

Herein, the fuel tank 16 is formed lower than the hydraulic oil tank 19 in terms of the height dimension. That is, the top surface portion 16E of the fuel tank 16 is disposed lower by a dimension H (see FIG. 7) than the top surface portion 19E of the hydraulic oil tank 19. As a result, the position of the foothold can be set lower even in cases where the top surface portion 16E of the fuel tank 16 is used as a foothold during work. For example, the height dimension of the fuel tank 16 (dimension from the ground to the top surface portion 16E as a foothold) can be set as the height dimension of guide rails stipulated by the ISO2867 standard (2011) or less.

The tank support base 17 and the tank support base 18 support the hydraulic oil tank 19 on the revolving frame 5. As shown in FIG. 7, the tank support base 17 located on the front side is mounted on the hydraulic oil tank attachment site 9B of the right front extension beam 9. Also, the tank support base 18 located on the rear side is mounted on the hydraulic oil tank attachment site 10A of the right rear extension beam 10. The tank support base 17 supports the hydraulic oil tank 19 on the revolving frame 5 at a position at which the bottom surface portion 19F of the hydraulic oil tank 19 is separated upward from the hydraulic oil tank attachment site 9B. Likewise, the tank support base 18 supports the hydraulic oil tank 19 on the revolving frame 5 at a position at which the bottom surface portion 19F of the hydraulic oil tank 19 is separated upward from the hydraulic oil tank attachment site 10A.

As a result, the tank support base 17 and the tank support base 18 support the hydraulic oil tank 19 at a position higher than that of the upper surface 8A of the right side frame 8 as one side frame. In this case, a dimension from the upper surface 8A of the right side frame 8 to the bottom surface portion 19F of the hydraulic oil tank 19, or a height dimension of the tank support base 17 and the tank support base 18 is set so as to allow the hydraulic oil tank 19 to be raised up to a position capable of displaying the position of the reference oil surface L1 at an intermediate position in the vertical direction of an oil level gauge 19G of the hydraulic oil tank 19.

The tank support base 17 located on the front side includes a lower mounting plate 17A mounted on the hydraulic oil tank attachment site 9B of the right front extension beam 9 using bolts (not shown), a wall panel 17B extending from an edge portion side of the lower mounting plate 17A to an upper side thereof, and an upper mounting plate 17C mounted on an upper end portion of the wall panel 17B and in parallel with the lower mounting plate 17A. The upper mounting plate 17C is mounted on the bottom surface portion 19F of the hydraulic oil tank 19, using bolts (not shown).

The tank support base 18 located on the rear side is formed so as to be symmetrical with the tank support base 17 located on the front side in a front-and-rear direction. The tank support base 18 on the rear side includes a lower mounting plate 18A, a wall plate 18B, and an upper mounting plate 18C, as shown in the tank support base 17 on the front side. The lower mounting plate 18A is mounted on the hydraulic oil tank attachment site 10A of the right rear extension beam 10 using bolts, and the upper mounting plate 18C is mounted on the bottom surface portion 19F of the hydraulic oil tank 19 using bolts.

Subsequently, the configuration of the hydraulic oil tank 19 that constitutes the characterizing portion of an embodiment of the present invention will be described.

A hydraulic oil tank 19 is provided on the revolving frame 5. The hydraulic oil tank 19 is disposed adjacent to the fuel tank 16 in the right-and-left direction on the side of the right side frame 8 closer to an outer side in the right-and-left direction than the fuel tank 16. That is, the hydraulic oil tank 19 is provided adjacent to the right side of the fuel tank 16 that is separated from the boom 4A of the working mechanism 4. The hydraulic oil tank 19 stores hydraulic oil driving each of the actuators including a hydraulic motor provided on the lower traveling structure 2 and cylinders 4D to 4F of the working mechanism 4. A front side portion of the hydraulic oil tank 19 is mounted on the hydraulic oil tank attachment site 9B of the right front extension beam 9, using the tank support base 17. Also, a rear side portion of the hydraulic oil tank 19 is mounted on the hydraulic oil tank attachment site 10A of the right rear extension beam 10, using the tank support base 18. In this case, the hydraulic oil tank 19 is supported by the tank support base 17 and the tank support base 18 at a position higher than those of the hydraulic oil tank attachment site 9B, the hydraulic oil tank attachment site 10A, and the upper surface 8A of the right side frame 8.

The hydraulic oil tank 19 is formed as a rectangular shaped container extending in the vertical direction, including a front surface portion 19A, a rear surface portion 19B, a left surface portion 19C, a right surface portion 19D, a top surface portion 19E, and a bottom surface portion 19F. In the hydraulic oil tank 19, the bottom surface portion 19F is mounted on the upper mounting plate 17C of the tank support base 17 and the upper mounting plate 18C of the tank support base 18 using bolts. As a result, the top surface portion 19E of the hydraulic oil tank 19 is disposed higher by a dimension H (see FIG. 7) than the top surface portion 16E of the fuel tank 16.

As shown in FIG. 8, the rear surface portion 19B located on the hydraulic pump 14 side is provided with the oil level gauge 19G by extending upward from an intermediate portion in the vertical direction. The oil level gauge 19G is provided to confirm the filling of an appropriate amount of hydraulic oil when the hydraulic oil tank 19 is filled with hydraulic oil. Air bleeding work is performed in a hydraulic circuit when the hydraulic oil tank 19 is filled with hydraulic oil.

In the air bleeding work, the hydraulic oil tank 19 is filled with hydraulic oil. An operator fills the hydraulic oil tank with hydraulic oil and confirms an overall distribution of hydraulic oil throughout each portion (i.e., air bleeding) by visually confirming the discharge of the hydraulic oil from an air hole (oil bleeding hole) 14A located at an uppermost portion of the hydraulic pump 14. At this time, the oil level gauge 19G is provided at the rear surface portion 19B on the hydraulic pump 14 side. Therefore, an operator can find the amount of the hydraulic oil filled in the hydraulic oil tank 19 by visually confirming the oil level gauge 19G. That is, the flow amount for filling hydraulic oil (amount to be filled per unit time) is set smaller when the surface level of hydraulic oil approximates the reference oil surface L1. This adjustment can prevent overflow of hydraulic oil from the air bleeding hole 14A of the hydraulic pump 14.

Herein, in the hydraulic oil tank 19 of this embodiment, the installation position is set higher by the tank support base 17 and the tank support base 18, using an existing hydraulic oil tank, for example. As a result, the top surface portion 19E of the hydraulic oil tank 19 can be disposed higher by a dimension H than the top surface portion 16E of the fuel tank 16. Therefore, in the hydraulic oil tank 19, it is not necessary to change the mounting position of the oil level gauge 19G, and a surface level position L2, upon the return of all the hydraulic oil, is also set lower than the top surface portion 19E.

Figure 2:
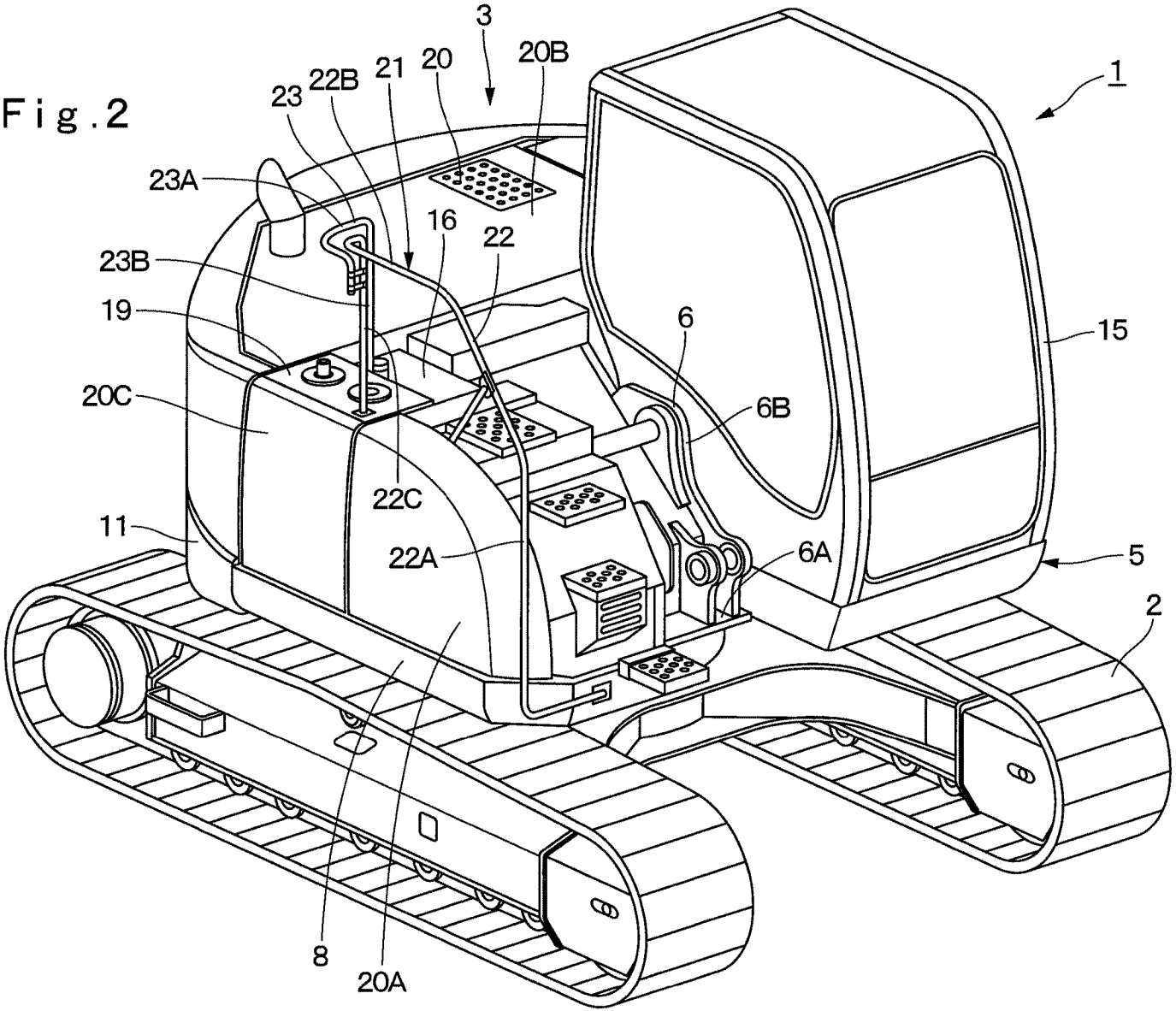
FIG. 2 is an enlarged perspective view of the hydraulic excavator viewed from the right front side without a working mechanism.

As shown in FIGS. 1 to 3, the exterior cover 20 covers onboard equipment mounted on the revolving frame 5. The exterior cover 20 is configured to include a right front cover 20A located on a front side of the fuel tank 16 and the hydraulic oil tank 19 opposite to the cab 15 in the right-and-left direction, an engine cover 20B located between the cab 15 and the counterweight 11 and covering an upper side of the engine 12 or the like, and a tank cover 20C covering the right side of the hydraulic oil tank 19.

The engine cover 20B is configured as a cover whose front side is openably front-open, with a rear end edge thereof as a fulcrum, for example. The equipment including the engine 12 can be maintained while the engine cover 20B is opened. Also, the right front cover 20A serves as a step for an operator to get on the upper revolving structure 3 when the fuel tank 16 is supplied with fuels, hydraulic oil in the hydraulic oil tank 19 is replaced or filled, or the engine cover 20B is opened for maintenance. As a result, the operator can get on an operational position on the front side of the engine cover 20B by placing a foot on the right front cover 20A and the fuel tank 16 for the maintenance of the engine 12, for example.

A handrail 21 is provided on the upper revolving structure 3 including the top surface portion 19E of the hydraulic oil tank 19. The handrail 21 is held by an operator, who gets on the top surface portion 16E of the fuel tank 16 or works on the top surface portion 16E as a foothold, for example. Specifically, the handrail 21 is configured by a front side handrail 22 for an operator to hold the right front cover 20A of the exterior cover 20 when getting on/off the vehicle and a rear side handrail 23 for an operator to hold when working on the top surface portion 19E of the hydraulic oil tank 19.

The front side handrail 22 is configured by a vertical pipe portion 22A whose lower end portion is mounted on the front portion of the right side frame 8 and extending upward, a horizontal pipe portion 22B having the same height position as the cab 15 and extending rearward from an upper end portion of the vertical pipe portion 22A, and a mounting pipe portion 22C extending downward from a rear end portion of the horizontal pipe portion 22B and whose lower end portion is mounted on the top surface portion 19E of the hydraulic oil tank 19.

The rear side handrail 23 is configured by an L-shaped pipe portion 23A whose front end portion is mounted on an upper portion of the mounting pipe portion 22C of the front side handrail 22 and bent rearward and leftward in L shape and a mounting pipe portion 23B extending downward from a left end portion of the L-shaped pipe portion 23A and whose lower end portion is mounted on the top surface portion 16E of the fuel tank 16.

Herein, according to the ISO2867 standard (2011), the handrail 21 can be formed with a smaller dimension than the guide rail. Therefore, the handrail 21 can be formed to meet the height limit range for transporting the hydraulic excavator 1.

As shown in FIG. 4, a control valve 24 is located in the right front cover 20A of the exterior cover 20 and provided on the revolving frame 5. The control valve 24 is configured as a collection of a plurality of directional control valves controlling the supply and discharge of pressurized oil to each of the hydraulic actuators such as a hydraulic motor of the lower traveling structure 2, the boom cylinder 4D, the arm cylinder 4E, and the bucket cylinder 4F of the working mechanism 4.

The hydraulic excavator 1 of this embodiment is configured as described, and subsequently, the operation of the hydraulic excavator 1 will be described.

An operator seated in a cab 15 starts the engine 12 to drive the hydraulic pump 14. As a result, pressurized oil traveling from the hydraulic pump 14 is supplied to actuators via the control valve 24. Therefore, the operator can move forward or backward the lower traveling structure 2 when operating the traveling control lever. Meanwhile, the operator can perform excavating work of earth and sand as operating the working mechanism 4 by operating the working control lever.

In the hydraulic excavator 1, hydraulic oil is regularly replaced. During the hydraulic oil replacement, air bleeding work is performed by bleeding internal air and filling the pump with hydraulic oil to prevent the compression performance of the hydraulic pump 14 from declining due to residual internal air in the hydraulic circuit including the hydraulic pump 14. In the air bleeding work, an overall distribution of hydraulic oil throughout each portion (i.e., air bleeding) is confirmed by discharging hydraulic oil from the air bleeding hole 14A located at the uppermost portion of the hydraulic pump 14 when filling the hydraulic oil tank 19 with hydraulic oil. At this time, an operator can work so as to avoid overflow of hydraulic oil from the air bleeding hole 14A by visually confirming the oil level gauge 19G provided at the hydraulic oil tank 19 and confirming whether the surface level height of the hydraulic oil approximates the reference oil surface L1 or not.

Herein, the hydraulic excavator 1 is formed as an ultra short rear tail swing radius type hydraulic excavator. For this reason, since the revolving frame 5 is produced in a compact size as well as the upper revolving structure 3, an installation space installing the engine 12, the hydraulic pump 14 and the like is extended upward. In conjunction therewith, the height dimension and the installation position of the engine 12, the hydraulic pump 14 and the like will be larger and higher, respectively.

According to this embodiment, the fuel tank 16 storing fuels is located between the right side frame 8 and the center frame 6 of the revolving frame 5 and is disposed on the center frame 6 side. The hydraulic oil tank 19 storing hydraulic oil is disposed adjacent to the fuel tank 16 in the right-and-left direction on the side of the right side frame 8 closer to an outer side in the right-and-left direction than the fuel tank 16. In addition, the top surface portion 19E of the hydraulic oil tank 19 is disposed at a position higher than the top surface portion 16E of the fuel tank 16.

Therefore, the fuel tank 16, even if formed with a height dimension lower than the hydraulic oil tank 19, can provide a maintenance foothold. As a result, the configuration can be simplified by using as a safety fence, the handrail 21 which is lower than a guide rail. In addition, the height dimension of the hydraulic excavator 1 can be kept in the range of the height dimension for transport to achieve easy transport. Consequently, the hydraulic excavator 1 can solve problems caused by larger height dimensions of the hydraulic oil tank 19.

The revolving frame 5 includes the hydraulic oil tank attachment site 9B and the hydraulic oil tank attachment site 10A placing the fuel tank 16 and the hydraulic oil tank 19 thereon. The tank support base 17 supporting the hydraulic oil tank 19 at a position at which the bottom surface portion 19F of the hydraulic oil tank 19 is separated upward from the hydraulic oil tank attachment site 9B and the tank support base 18 supporting the hydraulic oil tank 19 at a position at which the bottom surface portion 19F of the hydraulic oil tank 19 is separated upward from the hydraulic oil tank attachment site 10A are mounted on the hydraulic oil tank attachment site 9B and the hydraulic oil tank attachment site 10A. As a result, the height position of the oil level gauge 19G can be adjusted to the reference oil surface L1 only by raising the existing hydraulic oil tank 19 by the tank support base 17 and the tank support base 18. Consequently, the configuration can be modified at low cost, using an existing hydraulic oil tank 19.

The hydraulic excavator 1 includes a working foothold including the top surface portion 16E of the fuel tank 16. The top surface portion 19E of the hydraulic oil tank 19 is provided with the handrail 21 extending upward for an operator to hold and work on the foothold. As a result, the operator can safely get on/off the fuel tank 16 by holding the handrail 21 for the maintenance of the engine 12, for example.

One embodiment exemplifies a case where the fuel tank 16 and the hydraulic oil tank 19 are provided on the right side in the right-and-left direction of the upper revolving structure 3 that constitutes a vehicle body. Nevertheless, the present invention is not limited to that, and a fuel tank and a hydraulic oil tank may be provided on the left side in the right-and-left direction of a vehicle body.

One embodiment exemplifies a case where a hydraulic oil tank 19 is supported using a tank support base 17 and a tank support base 18 on a revolving frame 5. However, the present invention is not limited to that, and a hydraulic oil tank may directly be mounted on the revolving frame by increasing the height dimension of the hydraulic oil tank.

Moreover, one embodiment of the present invention illustrates a hydraulic excavator 1 with a crawler-type lower traveling structure 2 as a construction machine. However, the present invention is not limited to that, and may be employed in, for example, a hydraulic excavator with a wheel-type lower traveling structure. In addition, the present invention can widely be employed in other types of construction machines such as a hydraulic crane.

DESCRIPTION OF REFERENCE NUMERALS

1: Hydraulic excavator (Construction machine)
2: Lower traveling structure (Vehicle body)
3: Upper revolving structure (Vehicle body)
5: Revolving frame (Vehicle body frame)
6: Center frame
7: Left side frame
8: Right side frame
9: Right front extension beam
9B, 10A: Hydraulic oil tank attachment site (Tank attachment site)
10: Right rear extension beam
16: Fuel tank
16E, 19E: Top surface portion
17, 18: Tank support base
19: Hydraulic oil tank
19F: Bottom surface portion
21: Handrail

The invention claimed is:

1. A construction machine comprising:

a vehicle body frame composed of a support structural body of a vehicle body that is self-propelled in a front-and-rear direction and including a center frame disposed in the center in the right-and-left direction perpendicular to the front-and-rear direction, a left side frame provided on the left side of the center frame and extending in a front-and-rear direction, and a right side frame provided on the right side of the center frame and extending in the front-and-rear direction;

a fuel tank storing fuels provided on the vehicle body frame; and a hydraulic oil tank storing hydraulic oil provided on the vehicle body frame, wherein a front extension beam and a rear extension beam for supporting the right side frame or the left side frame to the center frame are disposed at an interval in a front-and-rear direction of the center frame, an upper portion of the front extension beam and an upper portion of the rear extension beam away from the center frame side from an intermediate portion in the right-and-left direction is a hydraulic oil tank attachment site, and closer to the center frame side from the intermediate portion is a fuel tank attachment site for supporting the fuel tank, the fuel tank attachment site is formed so as to have a smaller height dimension than the hydraulic oil tank attachment site, the hydraulic oil tank attachment site has a height position, which is higher than that of the fuel tank attachment site and equivalent to that of an upper surface of the right side frame or an upper surface of the left side frame, and is mounted on a tank support base supporting the hydraulic oil tank, the tank support base separated upward from the hydraulic oil tank attachment site at the bottom surface portion of the hydraulic oil tank, and a reference oil surface of a hydraulic oil in the hydraulic oil tank is set so as to a height dimension at an intermediate position of an oil level gauge provided in the hydraulic oil tank, and a top surface portion of the hydraulic oil tank supported by the tank support base is disposed at a position higher than that of a top surface portion of the fuel tank.

2. The construction machine according to claim 1, comprising a working foothold including the top surface portion of the fuel tank, wherein the top surface portion of the hydraulic oil tank is provided with a handrail extending upward for an operator to work on the foothold.

* * * * *